US006983697B2

(12) United States Patent
Hopper et al.

(10) Patent No.: US 6,983,697 B2
(45) Date of Patent: Jan. 10, 2006

(54) PRINTING COLOR LAYERS

(75) Inventors: Craig Hopper, Boise, ID (US); Robert W. Jewell, Meridian, ID (US); Jeffrey C. Madsen, Eagle, ID (US); Alfred D. Kirby, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 207 days.

(21) Appl. No.: 10/731,339

(22) Filed: Dec. 8, 2003

(65) Prior Publication Data

US 2005/0120895 A1 Jun. 9, 2005

(51) Int. Cl.
*B41F 5/02* (2006.01)
*B41F 5/22* (2006.01)
*B41F 13/24* (2006.01)

(52) U.S. Cl. ..... 101/492; 101/232; 101/217; 101/184; 101/211

(58) Field of Classification Search ..... 101/492, 101/232, 216, 217, 218, 247, 183, 184, 185, 101/175, 177, 211, 142, 144, 145, 152, 153, 101/154
See application file for complete search history.

(56) References Cited

U.S. PATENT DOCUMENTS 4,423,677 A * 1/1984 Fischer ..... 101/232
6,283,025 B1 * 9/2001 Simeth ..... 101/183
6,393,982 B2 * 5/2002 Simeth ..... 101/183

* cited by examiner

*Primary Examiner*—Leslie J. Evanisko

(57) ABSTRACT

An intermediate transfer member is disengaged from an impression drum. Color layers are applied to the intermediate transfer member. A sheet media is transported between the intermediate transfer member and the impression drum while the intermediate transfer member and the impression drum are disengaged. The intermediate transfer member is engaged with the impression drum. Another sheet media is transported between the intermediate transfer member and the impression drum. The color layers are transferred from the intermediate transfer member onto the sheet media.

24 Claims, 6 Drawing Sheets

PRINTING COLOR LAYERS

FIELD OF THE INVENTION

This invention relates in general to printing color layers and, more particularly, to applying color layers to an intermediate transfer member while the intermediate transfer member is disengaged from an impression drum.

BACKGROUND OF THE INVENTION

As color printing becomes more ubiquitous, faster color printing becomes more desirable. One of the limiting factors in color printing is the process by which color layers, or separations, are applied to the sheet media being printed. Each color layer is the layer for only one color.

In conventional multi-color simplex printing, a color layer is applied to an intermediate transfer member (ITM), or blanket. The color layer is then transferred to print media held by an impression drum (IMP). The print media is held on the IMP for as many cycles as there are colors used.

In conventional color printing, four colors are typically used; yellow, magenta, cyan, and black, though other colors and number are sometimes used as well. Where four colors are used, the sheet media is held on the IMP for four cycles. During each cycle, a single color layer is applied to the ITM and then transferred to the sheet media. This process limits the speed at which a sheet of media may be processed.

SUMMARY OF THE INVENTION

According to principles of the present invention, in one embodiment, an intermediate transfer member is disengaged from an impression drum. Color layers are applied to the intermediate transfer member while a sheet media is transported between the disengaged intermediate transfer member and impression drum. The intermediate transfer member is then engaged with the impression drum. Another sheet media is transported between the intermediate transfer member and the impression drum. The color layers are transferred from the intermediate transfer member onto the sheet media.

DETAILED DESCRIPTION OF THE INVENTION

Figure 1:
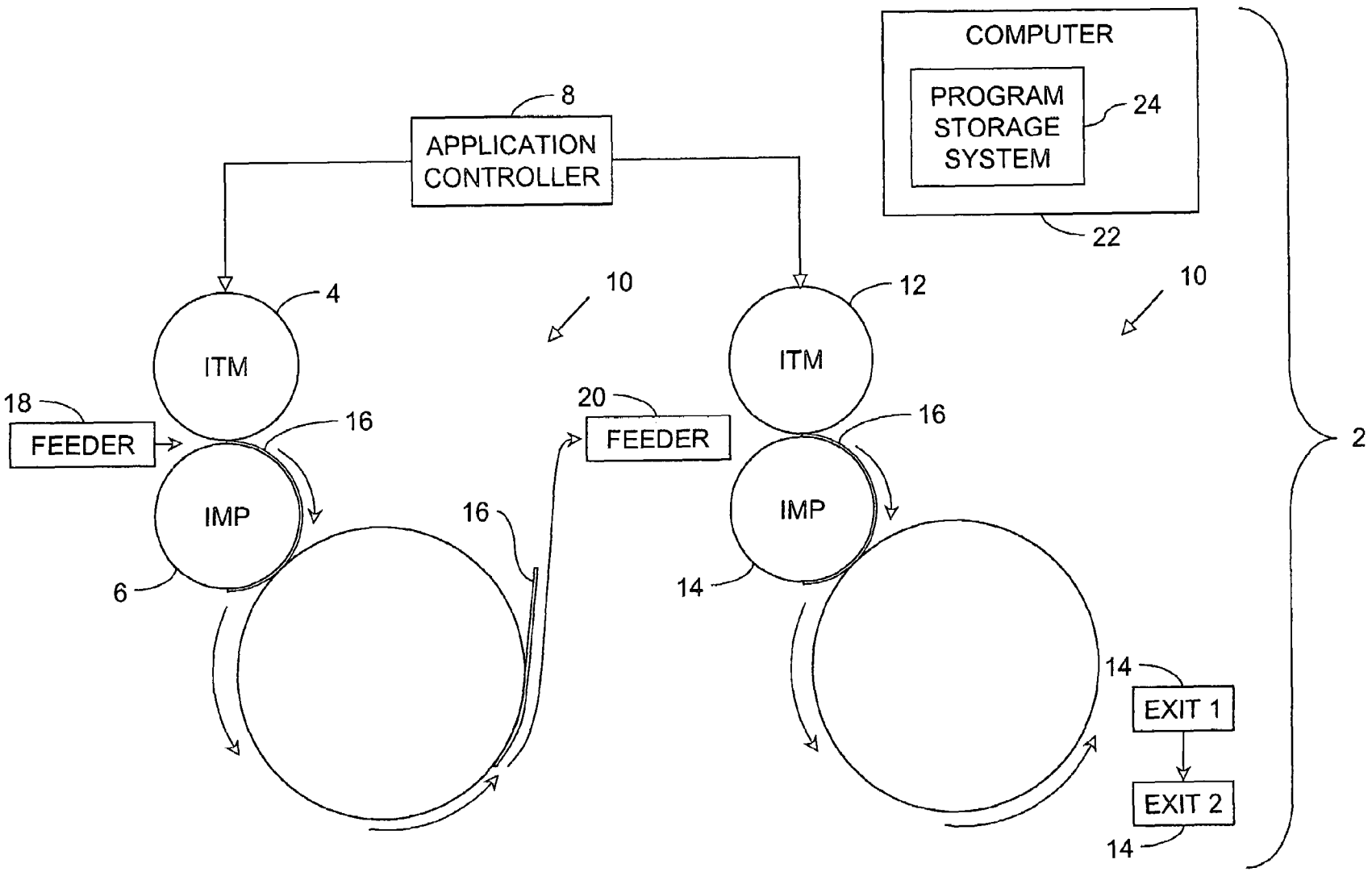
FIG. 1 is a depiction of one embodiment of the present invention printing system.

Illustrated in FIG. 1 is one embodiment of printing system 2. Printing system 2 includes first intermediate transfer member (ITM) 4, first impression drum (IMP) 6, application controller 8, transport system 10, and optionally second ITM 12, and second IMP 14. Printing system 2 is intended for use in printing to sheet media 16. Examples of sheet media 16 include paper, transparency film, and cardstock.

First ITM 4 is any apparatus or system configured to receive a plurality of color layers and transfer the color layers to sheet media 16. First IMP 6 is any apparatus or system selectively engageable with first ITM 4 and configured to hold sheet media 16 while first ITM 4 transfers color layers onto sheet media 16.

First IMP 6 is engaged with first ITM 4 when they are close enough for ITM 4 to transfer color layers to sheet media 16 held by IMP 6. First IMP 6 is disengaged with first ITM 4 when there is a gap between first IMP 6 and first ITM 4 such that ITM 4 cannot transfer color layers to sheet media 16 held by IMP 6.

In one embodiment, first IMP 6 is equipped to hold sheet media 16 while sheet media 16 passes over IMP 6. Commonly known examples of means for holding sheet media 16 include grippers positioned on IMP 6 and a vacuum system within IMP 6.

Second ITM 12 and second IMP 14 are like first ITM 4 and first IMP 6. Second ITM 12 and second IMP 14 are positioned relative to first ITM 4 and first IMP 6 so that sheet media 16 passes first through first ITM to 4 and first IMP 6, then through second ITM 12 and second IMP 14.

Application controller 8 is any combination of hardware and executable code configured to apply color layers to first ITM 4 and second ITM 12. In one embodiment, application controller 8 is configured to apply at least one color layer to first ITM 4 while first ITM 4 is disengaged from first IMP 6. In one embodiment, application controller 8 is further configured to, with first ITM 4 and first IMP engaged, apply at least one color layer to first ITM 4.

In another embodiment, application controller 8 is further configured to apply at least one color layer to second ITM 12 while second ITM 12 is disengaged from second IMP 14. In another embodiment, application controller 8 is further configured to apply, with second ITM 12 and second IMP engaged, at least one color layer to second ITM 12.

Transport system 10 is any apparatus or system configured to transport sheet media 16. In one embodiment, transport system 10 includes feeders 18, 20. Transport system 10 is configured to transport sheet media 16 between first ITM 4 and first IMP 6 and second ITM 12 and second IMP 14. While between each ITM and IMP pair, sheet media 16 is on the IMP, either for receiving a color layer from the ITM or merely passing through.

In one embodiment, transport system 10 is further configured to transport sheet media 16 between first ITM 4 and first IMP 6 while first ITM 4 and first IMP 6 are disengaged. In another embodiment, transport system 10 is further configured to transport sheet media 16 between first ITM 4 and first IMP 6 while applying one of the color layers to first ITM 4.

In another embodiment, transport system 10 is further configured to transport sheet media 16 between second ITM 12 and second IMP 14 while second ITM 12 and second IMP 14 are disengaged. In another embodiment, transport system 10 is further configured to transport sheet media 16 between second ITM 12 and second IMP 14 while applying one of the color layers to second ITM 12.

Optionally, printing system 2 further includes computer 22 and program storage system 24. Either or both of application controller 8 and transport system 10 may be partially embodied within computer 22.

Computer 22 is any combination of hardware and executable code configured to execute executable code stored in program storage system 24. Program storage system 24 is any device or system configured to store data or executable code. Program storage system 24 may also be a program storage system tangibly embodying a program, applet, or instructions executable by computer 22 for performing the method steps of the present invention executable by computer 22. Program storage system 24 may be any type of storage media such as magnetic, optical, or electronic storage media.

Program storage system 24 is illustrated in FIG. 1 as a single device. Alternatively, program storage system 24 may include more than one device. Furthermore, each device of program storage system 24 may be embodied in a different media type. For example, one device of program storage system 24 may be a magnetic storage media while another device of program storage system 24 is an electronic storage media.

Figure 2A:
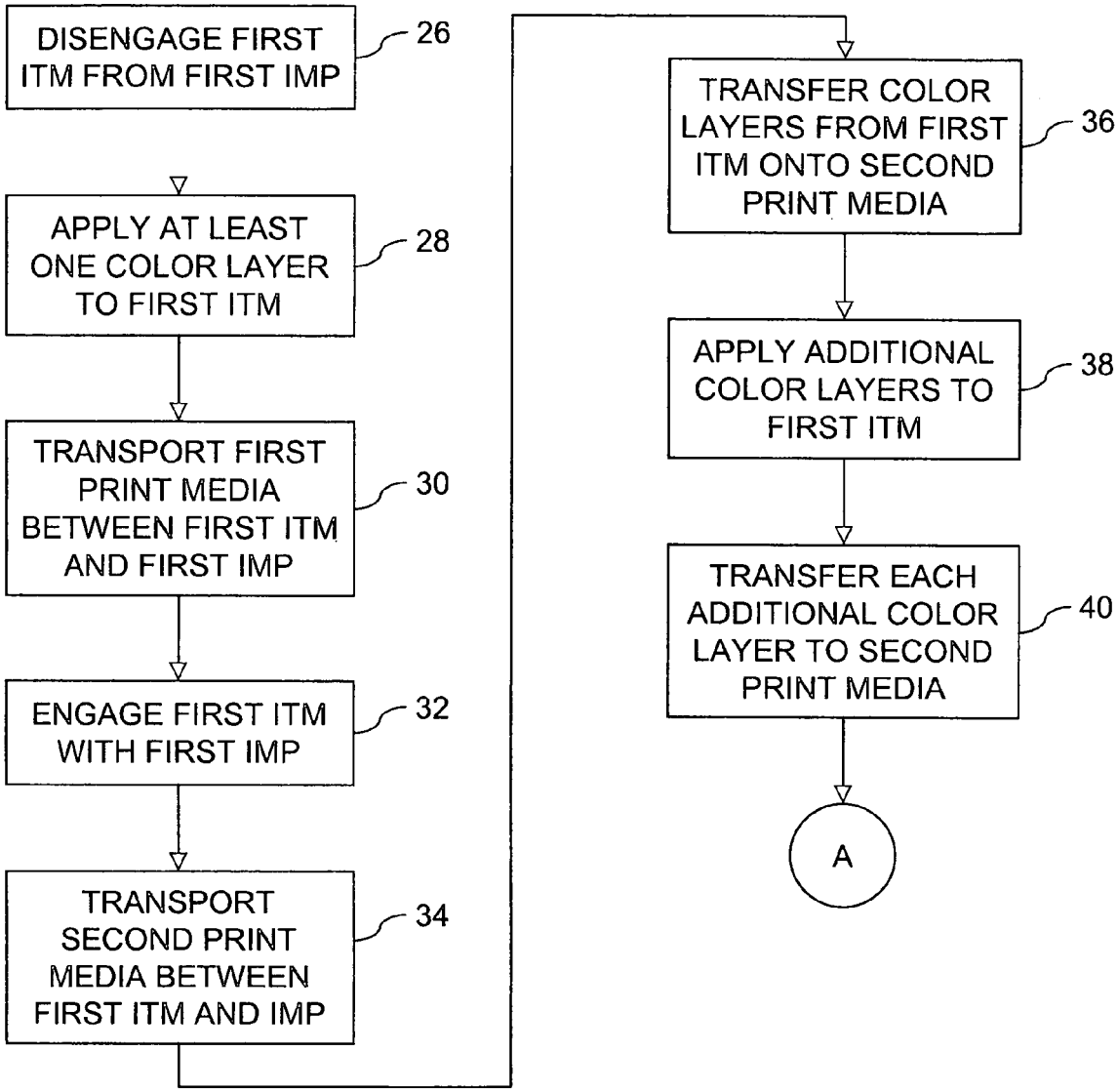
FIGS. 2A and 2B are a flow chart illustrating one embodiment of the present invention method for printing.
Figure 2B:
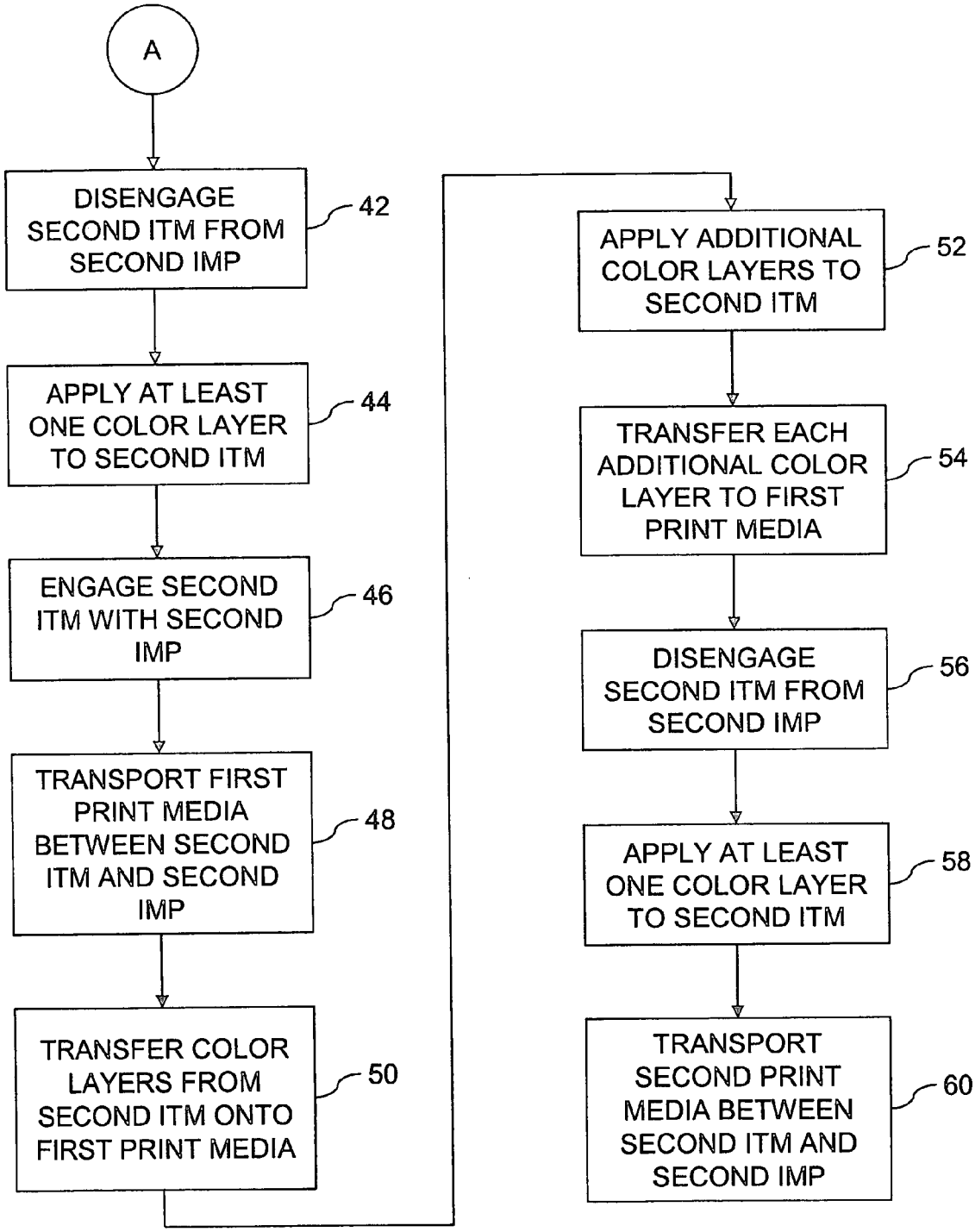

FIGS. 2A and 2B are a flow chart representing steps of one embodiment of the present invention. Although the steps represented in FIGS. 2A and 2B are presented in a specific order, the present invention encompasses variations in the order of steps. Furthermore, additional steps may be executed between the steps illustrated in FIGS. 2A and 2B without departing from the scope of the present invention.

Figure 3A:
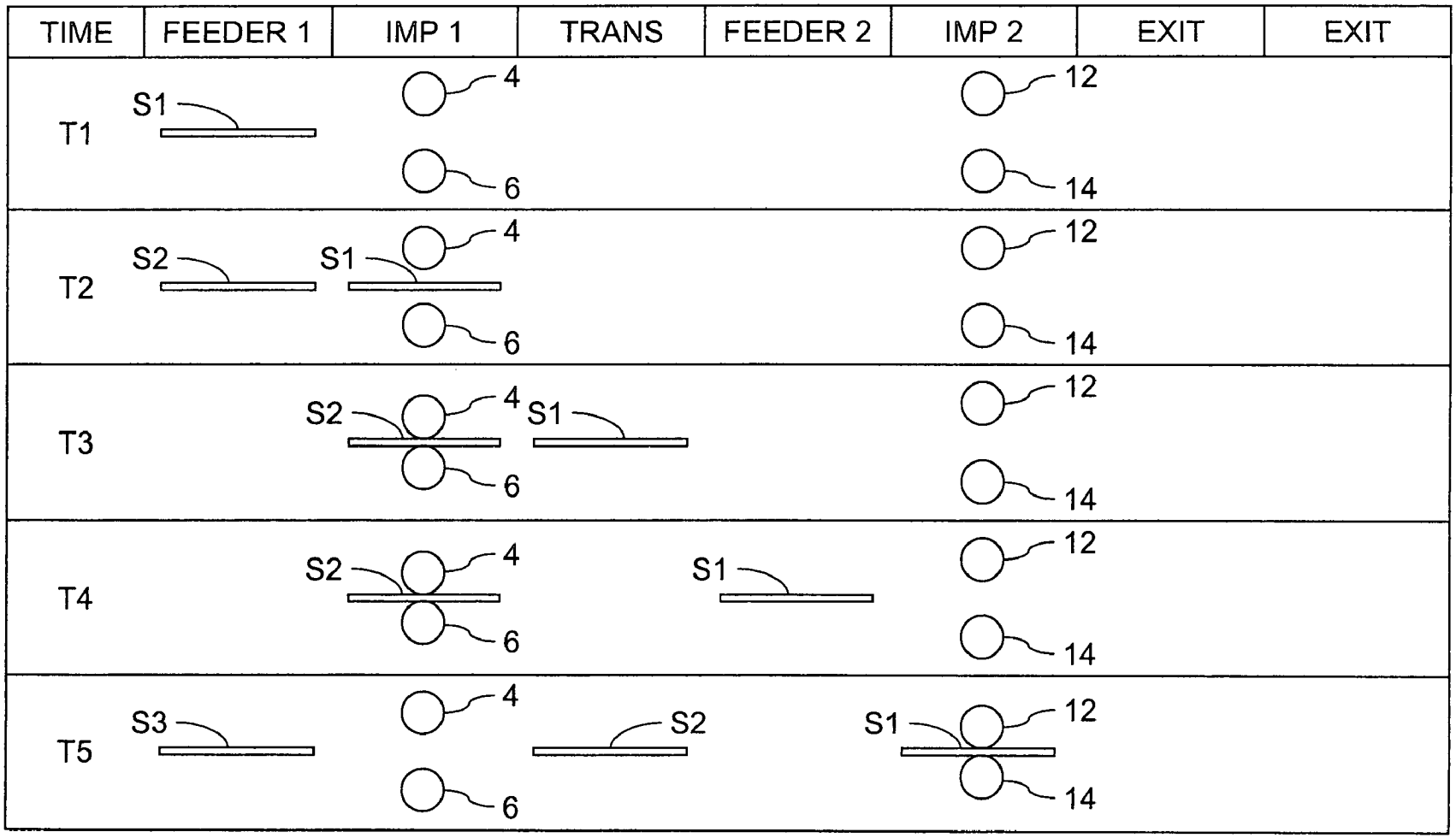
FIGS. 3A–3C illustrates a timing flow diagram of one embodiment of the transport system of the present invention printing system.
Figure 3B:
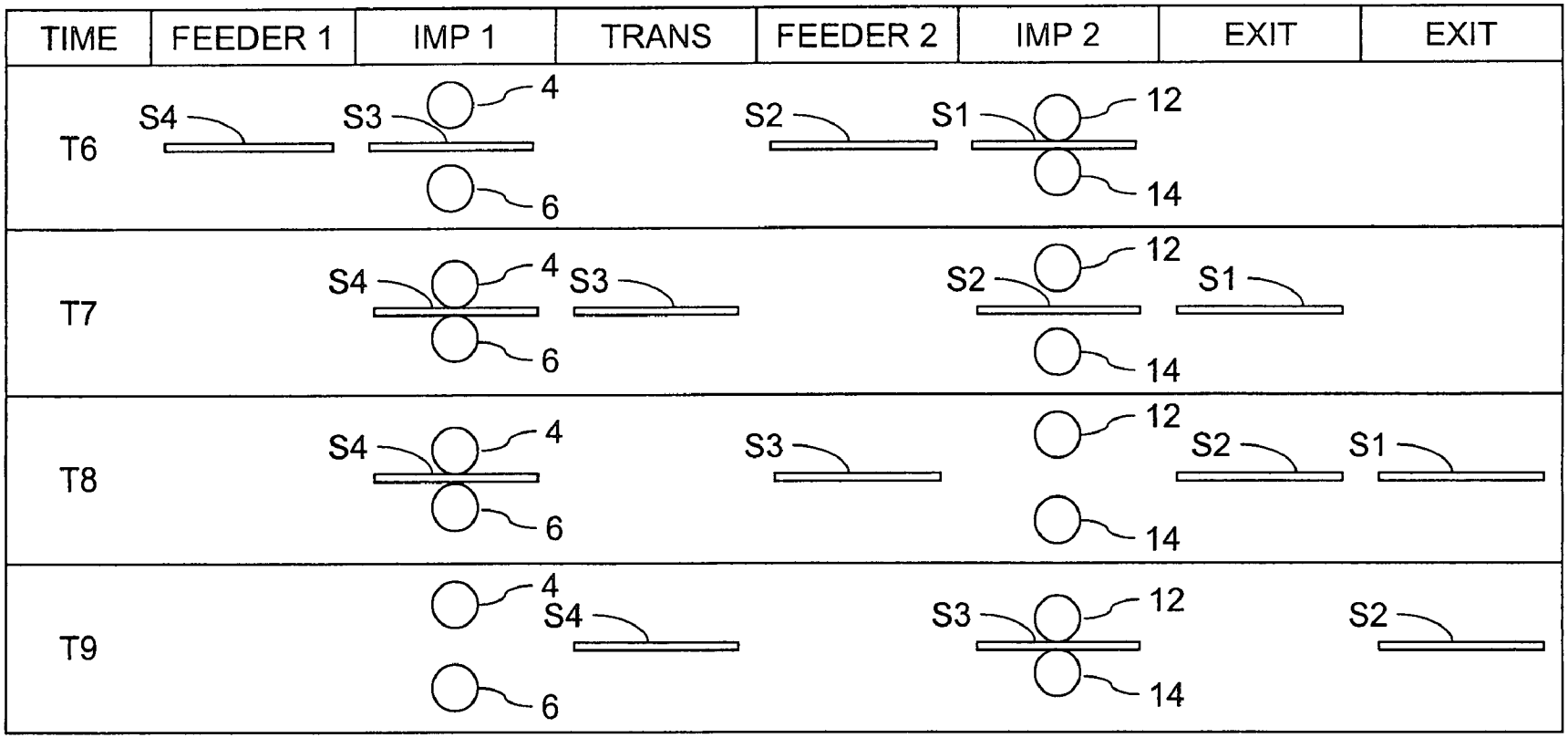
Figure 3C:
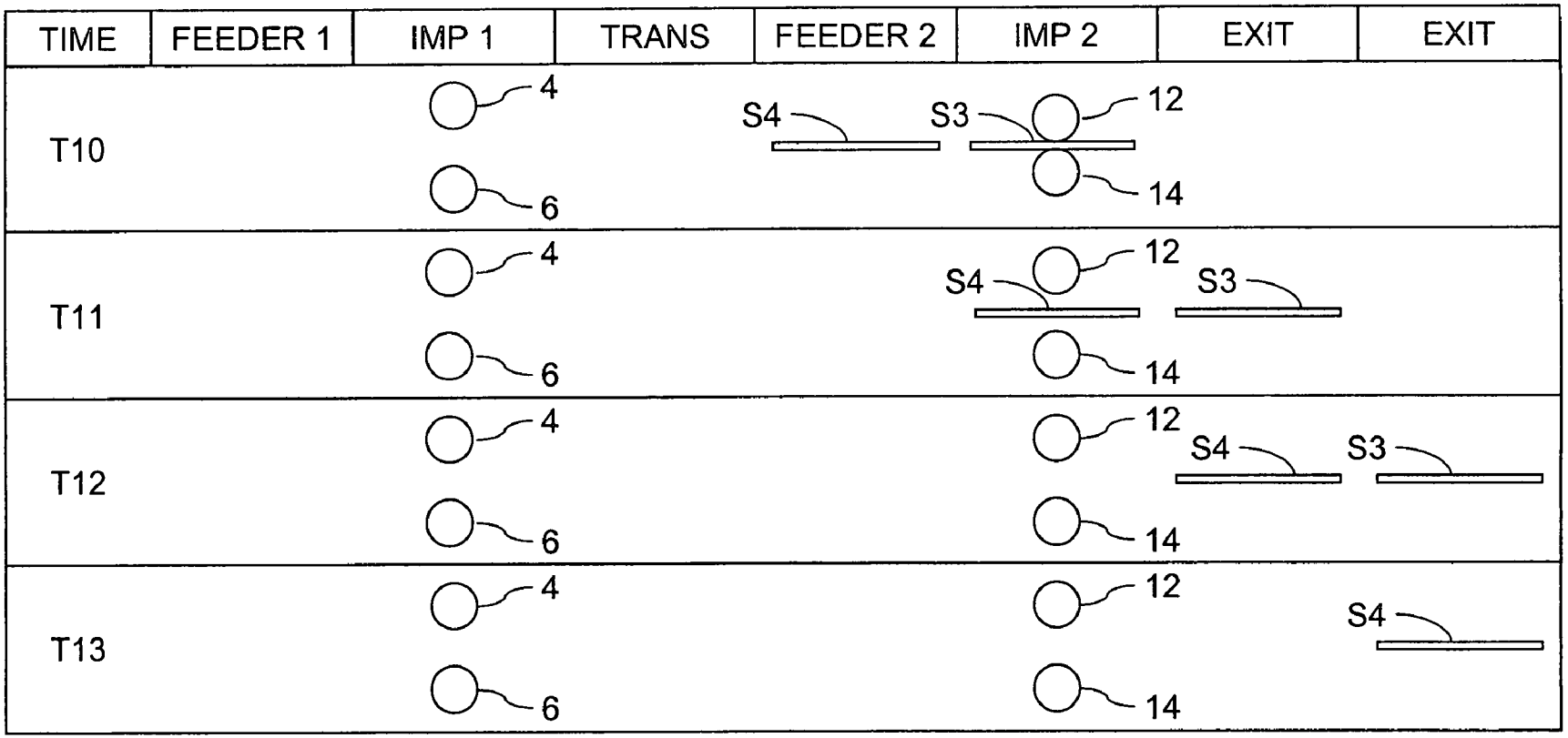

One embodiment of the timing and transport system of the present invention printing system 2 is illustrated in FIGS. 3A–3C and discussed below in some detail with FIGS. 2A and 2B and in more detail after the discussion of FIGS. 2A and 2B.

First ITM is disengaged 26 from first IMP 6. At least one color layer is applied 28 to first ITM 4. Optionally, sheet media S1 is transported 30 between first ITM 4 and first IMP 6 while first ITM 4 and first IMP 6 are disengaged 26. Optionally, sheet media S1 is transported between first ITM 4 and first IMP 6 while one of the color layers is applied 28 to first ITM 4. Color layers applied 28 to first ITM 4 are not transferred to sheet media S1. After passing between first ITM 4 and first IMP 6, sheet media moves toward second ITM 12 and second IMP 14.

First ITM 4 is engaged 32 with first IMP 6. Sheet media S2 is transported 34 between first ITM 4 and first IMP 6. The color layers are transferred 36 from first ITM 4 onto sheet media S2.

Optionally, with first ITM 4 and first IMP 6 engaged, at least one additional color layer is applying 38 to first ITM 4. Each additional color layer is transferred 40 to sheet media S2.

Optionally, second ITM 12 is disengaged 42 from second IMP 14. At least one color layer is applied 44 to second ITM 12 while second ITM 12 is disengaged 42 from second IMP 14. Second ITM 12 is then engaged 46 with second IMP 14. Sheet media S1 is transported 48 between second ITM 12 and second IMP 14. The color layers are transferred 50 from second ITM 12 onto sheet media S1.

Optionally, with second ITM 12 and second IMP 14 engaged, at least one additional color layer is applying 52 to second ITM 12. Each additional color layer is transferred 54 to sheet media S1.

Second ITM 12 is disengaged 56 from second IMP 14 after the color layers are transferred 50, 54 to sheet media S1. At least one color layer is applied 58 to second ITM 12 while second ITM 12 is disengaged 42 from second IMP 14. Sheet media S2 is transported 60 between second ITM 12 and second IMP 14 while second ITM 12 and second IMP 14 are disengaged 56.

Tables 1 and 2 illustrate specific examples of timing that may be used to practice the present invention. Table 1 is illustrated by FIGS. 3A–3C. Table 2 is an alternate embodiment, to the timing example of Table 1.

At time t1, sheet S1 is in feeder 18 and a color layer is applied to ITM 4. The "*" in Tables 1 and 2 indicates that the ITM is being loaded with a color layer while the ITM is disengaged from its IMP. As shown in FIG. 3A, first ITM 4 and first IMP 6 are disengaged.

At time t2, ITM 4 remains disengaged from IMP 6 as sheet S1 is moved onto first IMP 6 and a color layer is applied to ITM 4. Since ITM 4 and IMP 6 are disengaged, the color layers on ITM 4 are not transferred to sheet S1. Also at time t2, sheet S2 is positioned in feeder 18.

At time t3, sheet S1 is transported towards IMP 14, ITM 4 and IMP 6 engage, and sheet S2 is transported onto IMP 6. An additional color layer is applied onto ITM 4 and all three color layers are transferred to sheet S2. Additionally, a color layer is applied to ITM 12.

At time t4, sheet S1 is positioned in feeder 20 while another color layer is applied to ITM 12. Also, another color layer is applied to ITM 4 and transferred to sheet S2.

At time t5, ITM 12 and IMP 14 engage, and sheet S1 is transported onto IMP 14. An additional color layer is applied onto ITM 12 and all three color layers are transferred to sheet S1. ITM 4 and IMP 6 disengage and sheet S2 is transported towards IMP 14. A color layer is applied to ITM 4, which is intended to be later transferred to Sheet S4. Also, sheet S3 is positioned in feeder 18.

TABLE 1

| Position | Time | t1 | t2 | t3 | t4 | t5 | t6 | t7 | t8 | t9 | t10 | t11 | t12 | t13 |
|---|---|---|---|---|---|---|---|---|---|---|---|---|---|---|
| 1 | Feeder 18 | S1 | S2 | | | S3 | S4 | | | | | | | |
| 2 | IMP 6 | * | S1* | S2 | S2 | * | S3* | S4 | S4 | | | | | |
| 3 | Transport | | | S1 | | S2 | | S3 | | S4 | | | | |
| 5 | Feeder 20 | | | | S1 | | S2 | | S3 | | S4 | | | |
| 6 | IMP 14 | | | * | * | S1 | S1 | S2* | * | S3 | S3 | S4 | | |
| 7 | Exit | | | | | | | S1 | S2 | | | S3 | S4 | |
| 8 | Exit | | | | | | | | S1 | S2 | | | S3 | S4 |

At time t6, another color layer is applied to ITM 12 and is then transferred to sheet S1. Sheet S2 is positioned in feeder 20, sheet S3 passes between IMP 6 and ITM 4 while a color layer is applied to ITM 4, and sheet S4 is positioned in feeder 18.

At time t7, ITM 12 and IMP 14 disengage and sheet S1 is released from IMP 14, moving towards the exit. Sheet S2 passes between ITM 12 and IMP 14 while a color layer is applied to ITM 12, which is intended for sheets S3. Sheet S3 is transported towards ITM 12 and IMP 14. ITM 4 and IMP 6 engage, and sheet S4 is transported onto IMP 6. An additional color layer is applied onto ITM 4 and all three color layers are transferred to sheet S4.

At times t8 and t9, sheets S1 and S2 exit. As the process of sheets S3 and S4 are similar to sheets S1 and S2, further discussion of S3 and S4 are omitted. Additionally, although the example illustrated in Table 1 and FIGS. 3A–3C shows only four sheets, any number of sheets may be processed using the present invention system and method.

Table 2 illustrates another example of a timing chart for use by the present invention system and method.

TABLE 2

| Position | Time | t1 | t2 | t3 | t4 | t5 | t6 | t7 | t8 | t9 | t10 | t11 | t12 | t13 |
|---|---|---|---|---|---|---|---|---|---|---|---|---|---|---|
| 1 | Feeder 18 | S1 | | S2 | | S3 | | S4 | | | | | | |
| 2 | IMP 6 | * | S1* | * | S2 | * | S3* | * | S4 | | | | | |
| 3 | Transport | | | S1 | | S2 | | S3 | | S4 | | | | |
| 5 | Feeder 20 | | | | S1 | | S2 | | S3 | | S4 | | | |
| 6 | IMP 14 | | * | * | * | S1 | * | S2* | * | S3 | | S4 | | |
| 7 | Exit | | | | | | S1 | | S2 | | S3 | | S4 | |
| 8 | Exit | | | | | | | S1 | | S2 | | S3 | | S4 |

One advantage of the system and method of the present invention is that in a system with multiple print engines in series, a first sheet media may be transported through the first print engine, without printing to the first sheet media, while the first print applies a color layer to the ITM. The color layer is then transferred to a subsequent sheet media. The time during which the first sheet media passed through the first print engine is used effectively to further the printing process.

Two color print engine units can be placed in series with one other so that both units can be printing simultaneously, effectively doubling the output. To fully realize a doubled output speed, each unit must have blank paper present at its input. This requires either a by-pass paper path or a loss of one printing cycle, which would reduce the output to less than twice the speed of a single unit.

With this invention, no color print engine cycles are lost while a sheet media is passed through one engine, without receiving color, into a second engine where it will receive color. This allows two color print engines to be placed in series and get double the output of a single standalone engine.

The foregoing description is only illustrative of the invention. Various alternatives and modifications can be devised by those skilled in the art without departing from the invention. Accordingly, the present invention embraces all such alternatives, modifications, and variances that fall within the scope of the appended claims.

What is claimed is:

1. A method for printing to sheet media, the method comprising:

disengaging a first intermediate transfer member (ITM) from a first impression drum (IMP), applying at least one color layer to the first ITM while the first ITM and the first IMP are disengaged, transporting a first sheet media between the first ITM and the first IMP while the first ITM and the first IMP are disengaged, engaging the first ITM with the first IMP, transporting a second sheet media between the first ITM and the first IMP, and transferring the color layers from the first ITM onto the second sheet media.

2. The method of claim 1 wherein applying at least one color layer to the first ITM includes applying at least one color layer to the first ITM while transporting the first sheet media between the first ITM and the first IMP.

3. The method of claim 1 further including, with the first ITM and first IMP engaged, applying at least one additional color layer to the first ITM and transferring each additional color layer to the second sheet media.

4. The method of claim 1 further including:

disengaging a second ITM from a second IMP, applying at least one color layer to the second ITM while the second ITM and the second IMP are disengaged, engaging the second ITM with the second IMP, transporting the first sheet media between the second ITM and the second IMP, and transferring the color layers from the second ITM onto the first sheet media.

5. The method of claim 4 further including, with the second ITM and second IMP engaged, applying at least one additional color layer to the second ITM and transferring each additional color layer to the first sheet media.

6. The method of claim 4 further including:

disengaging the second ITM from a second IMP after the color layers are transferred to the first sheet media and transporting the second sheet media between the second ITM and the second IMP while the second ITM and the second IMP are disengaged.

7. The method of claim 1 further including:

disengaging a second ITM from a second IMP, applying at least one color layer to the second ITM, and transporting the second sheet media between the second ITM and the second IMP while applying one of the color layers to the second ITM.

8. The method of claim 1 further including:

disengaging a second ITM from a second IMP and transporting the second sheet media between the second ITM and the second IMP while the second ITM and the second IMP are disengaged.

9. A printing system for printing to sheet media, the printing system comprising;

a first intermediate transfer member (ITM) configured to receive a plurality of color layers and transfer the color layers to the sheet media;

a first impression drum (IMP) selectively engageable with the first ITM, the first IMP configured to hold the sheet media while the first ITM transfers color layers onto the sheet media;

an application controller configured to apply at least one color layer to the first ITM while the first ITM is disengaged from the first IMP; and a transport system configured to transport a first sheet media between the first ITM and the first IMP while the first ITM and the first IMP are disengaged and to transport a second sheet media between the first ITM and the first IMP while the first ITM and the first IMP are engaged.

10. The printing system of claim 9 wherein the application controller is further configured to, with the first ITM and first IMP engaged, apply at least one color layer to the first ITM.

11. The printing system of claim 9 wherein the transport system is further configured to transport the first sheet media between the first ITM and the first IMP while applying a color layer to the first ITM.

12. The printing system of claim 9 further including a second ITM configured to receive a plurality of color layers and transfer the color layers to the sheet media;

a second IMP selectively engageable with the second ITM, the second IMP configured to hold the sheet media while the second ITM transfers color layers onto the sheet media; and wherein the transport system is further configured to transport the sheet media between the second ITM and the second IMP.

13. The printing system of claim 12 wherein the application controller is further configured to apply at least one color layer to the second ITM while the second ITM is disengaged from the second IMP.

14. The printing system of claim 12 wherein the application controller is further configured to, with the second ITM and second IMP engaged, apply at least one color layer to the second ITM.

15. The printing system of claim 12 wherein the transport system is further configured to transport the sheet media between the second ITM and the second IMP while the second ITM and the second IMP are disengaged.

16. The printing system of claim 12 wherein the transport system is further configured to transport the sheet media between the second ITM and the second IMP while applying one of the color layers to the second ITM.

17. A program storage system readable by a computer, tangibly embodying a program, applet, or instructions executable by the computer to perform method steps for controlling a printing system, the method comprising:

disengaging a first intermediate transfer member (ITM) from a first impression drum (IMP), applying at least one color layer to the first ITM while the first ITM and the first IMP are disengaged, transporting a first sheet media between the first ITM and the first IMP while the first ITM and the first IMP are disengaged, engaging the first ITM with the first IMP, transporting a second sheet media between the first ITM and the first IMP, and transferring the color layers from the first ITM onto the second sheet media.

18. The program storage system of claim 17 wherein applying at least one color layer to the first ITM includes applying at least one color layer to the first ITM while transporting the first sheet media between the first ITM and the first IMP.

19. The program storage system of claim 18 wherein the method further includes, with the first ITM and first IMP engaged, applying at least one additional color layer to the first ITM and transferring each additional color layer to the second sheet media.

20. The program storage system of claim 18 wherein the method further includes:

disengaging a second ITM from a second IMP, applying at least one color layer to the second ITM while the second ITM and the second IMP are disengaged, engaging the second ITM with the second IMP, transporting the first sheet media between the second ITM and the second IMP, and transferring the color layers from the second ITM onto the first sheet media.

21. The program storage system of claim 20 wherein the method further includes, with the second ITM and second IMP engaged, applying at least one additional color layer to the second ITM and transferring each additional color layer to the first sheet media.

22. The program storage system of claim 20 wherein the method further includes:

disengaging the second ITM from a second IMP after the color layers are transferred to the first sheet media and transporting the second sheet media between the second ITM and the second IMP while the second ITM and the second IMP are disengaged.

23. The program storage system of claim 18 wherein the method further includes:

disengaging a second ITM from a second IMP, applying at least one color layer to the second ITM, and transporting the second sheet media between the second ITM and the second IMP while applying one of the color layers to the second ITM.

24. The program storage system of claim 18 wherein the method further includes:

disengaging a second ITM from a second IMP and transporting the second sheet media between the second ITM and the second IMP while the second ITM and the second IMP are disengaged.

* * * * *